US005934674A

United States Patent [19]

Bukowsky

[11] Patent Number: 5,934,674

[45] **Date of Patent: *Aug. 10, 1999**

[54] STOCK MARKET GAME

[76] Inventor: Clifton R. Bukowsky, 3844 Shore Crest, Dallas, Tex. 75209-1630

[ * ] Notice: This patent issued on a continued prosecution application filed under 37 CFR 1.53(d), and is subject to the twenty year patent term provisions of 35 U.S.C. 154(a)(2).

[21] Appl. No.: 08/652,172

[22] Filed: May 23, 1996

[51] Int. Cl.[6] ..... A63F 3/00; A63F 9/22

[52] U.S. Cl. ..... 273/278; 273/237; 463/9

[58] Field of Search ..... 273/237, 242, 273/243, 248, 256, 257, 258, 278, 279, 292, 293, 297, 302, 148 B, 429, 430, 431, 432; 463/9, 48; 364/410

[56] References Cited

U.S. PATENT DOCUMENTS

| | | | |
|---|---|---|---|
| 3,163,424 | 12/1964 | Lindsey | 273/278 |
| 3,765,682 | 10/1973 | Baude | 273/256 |
| 4,040,629 | 8/1977 | Kelly | 273/237 X |
| 4,363,489 | 12/1982 | Chodak et al. | 273/237 |
| 4,378,942 | 4/1983 | Isaac | 273/278 |
| 4,840,382 | 6/1989 | Rubin | 273/237 |
| 5,139,269 | 8/1992 | Peterson | 273/256 |
| 5,713,793 | 2/1998 | Holte | 463/9 X |

FOREIGN PATENT DOCUMENTS

| | | | |
|---|---|---|---|
| 6154420 | 6/1994 | Japan . | |
| 2234181 | 1/1991 | United Kingdom | 273/278 |

*Primary Examiner*—Michael O'Neill
*Attorney, Agent, or Firm*—David H. Judson

[57] ABSTRACT

A stock market game apparatus is disclosed. The apparatus includes a game board defining a game piece movement pathway thereon including a plurality of movement units. At least some of these movement units are associated with a plurality of stocks used for building stock portfolios among the game players. A display unit provides players with information concerning the current value of stocks within the game and providing a running total of the value of the stock portfolios they have built. The values of these stock portfolios are determined by receiving and inserting ownership tokens into slots associated with the player's stock portfolio. This action selects a particular valuation algorithm associated with the stock that determines the value of the stock using a processor internal to the display.

18 Claims, 2 Drawing Sheets

STOCK MARKET GAME

TECHNICAL FIELD

This invention relates to gaming apparatus, and more particularly to a stock market game for teaching individuals many of the concepts relating to stocks and stock trading.

BACKGROUND OF THE INVENTION

The last several years have seen explosive growth in the area of investments involving stocks and mutual funds. Increased interest in these areas provide a greater need and opportunity for educating individuals with respect to the general concepts utilized in investing in the stock market. Classic teaching methods are limited with respect to teaching general concepts of the stock market since these methods are normally not very entertaining. However, a method incorporating general concepts of the stock market and investing into a game that is both educational but highly entertaining would greatly assist in the education of individuals with respect to the stock market while also providing an entertaining game environment.

BRIEF SUMMARY OF THE INVENTION

The present invention comprises a stock market game consisting of a game board, display, stock ownership tokens and action cards. The game board has a playing surface defining a game piece movement pathway thereon. The game piece movement pathway comprises a plurality of movement squares or units wherein at least some of the movement units are associated with the stocks making up the stock portfolios to be built by players. A spinner or dice defines movement distance by a game ownership token around the movement pathway.

The means for displaying, in the preferred embodiment an electronic display, displays the current values of each of the stocks used in the game. The display also reveals the current value of each of the stock portfolios owned by the game players. The display is operated by a processor that determines the values of the portfolios based upon a selected one of a plurality of valuation algorithms. A plurality of ownership tokens are associated with each one of the plurality of stocks used within the game. A particular ownership token associated with a stock is inserted into the display means to select a valuation algorithm to be used for determining a portfolio value containing the stock. Each ownership token for a stock includes means for selecting a different valuation algorithm for portfolios containing the stock. Additional buttons or actuators on the display select additional valuation algorithms which effect the overall average values of each of the stocks and portfolios.

The foregoing has outlined some of the more pertinent aspects of the present invention. These aspects should be construed to be merely illustrative of some of the more prominent features and applications of the invention. Many other beneficial results can be attained by applying the disclosed invention in a different manner of modifying the invention as will be described. Accordingly, other aspects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION

Figure 1:
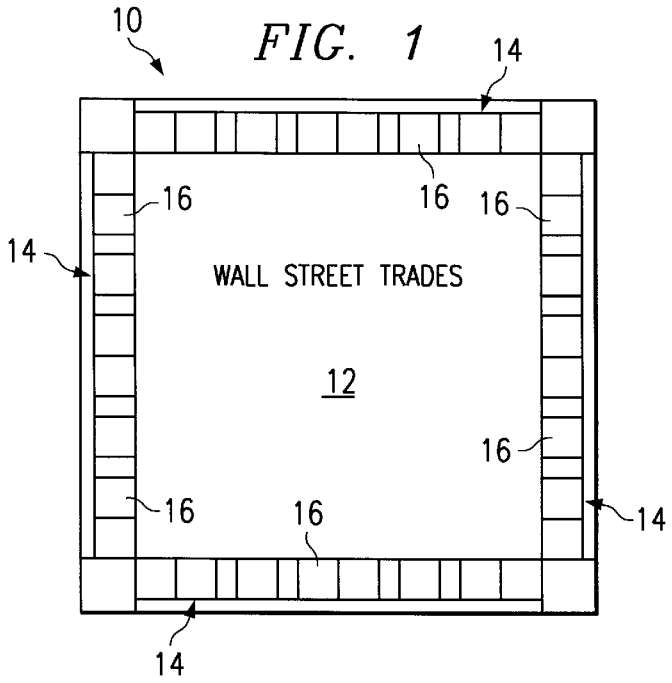
FIG. 1 is a top view of the game board playing surface of the stock game.

Referring now to the drawings and more particularly to FIG. 1, there is illustrated a top view of the game board 10 for the stock market game. The game board surface 12 defines a game piece movement pathway 14 extending around the periphery of the game board 10. It should be realized that any game piece movement pathway 14 across the game board surface 12 would be possible. The game piece movement pathway is divided into a number of movement units 16 through which a game piece (not shown) would be moved in accordance with a dice roll or spinner use. Several of the movement units 16 are associated with one of the plurality of stocks that are used for building player stock portfolios within the game.

Figure 3:
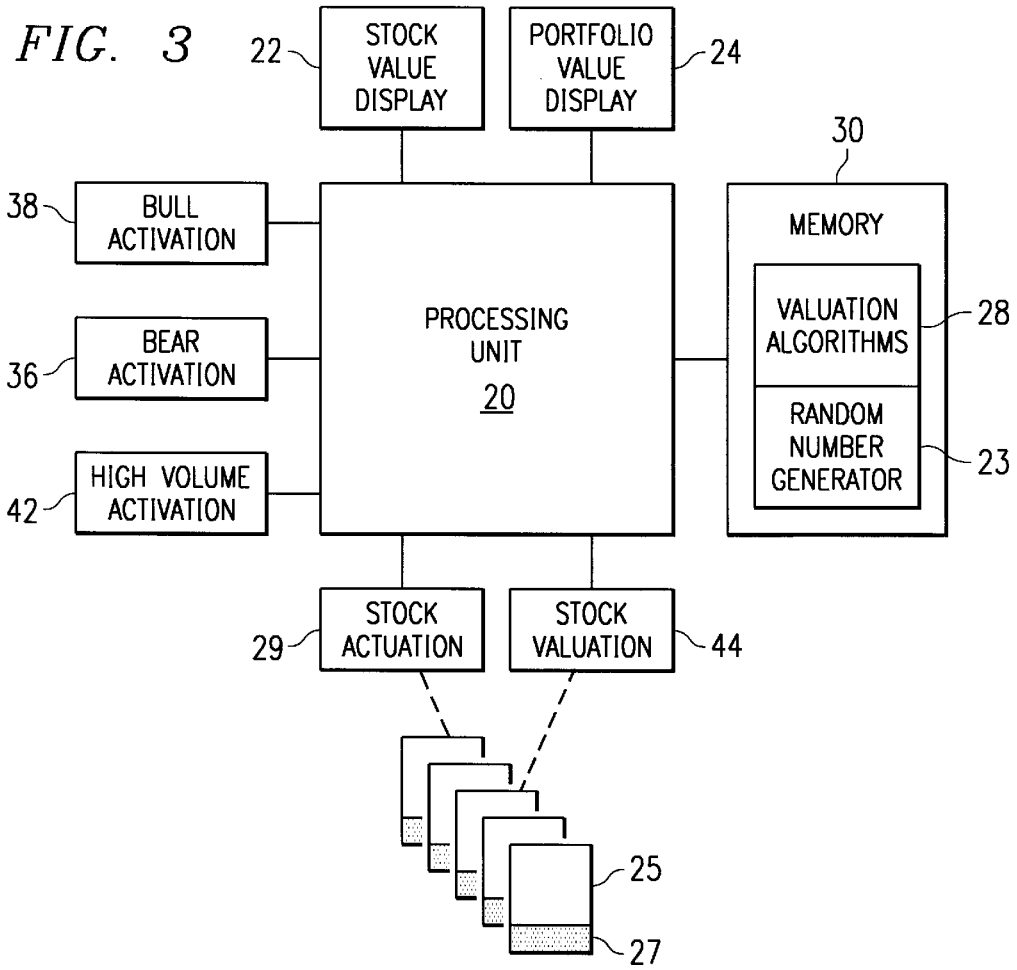
FIG. 3 is a block level diagram of the processor associated with the electronic display and the various components with which the display interacts.
Figure 2:
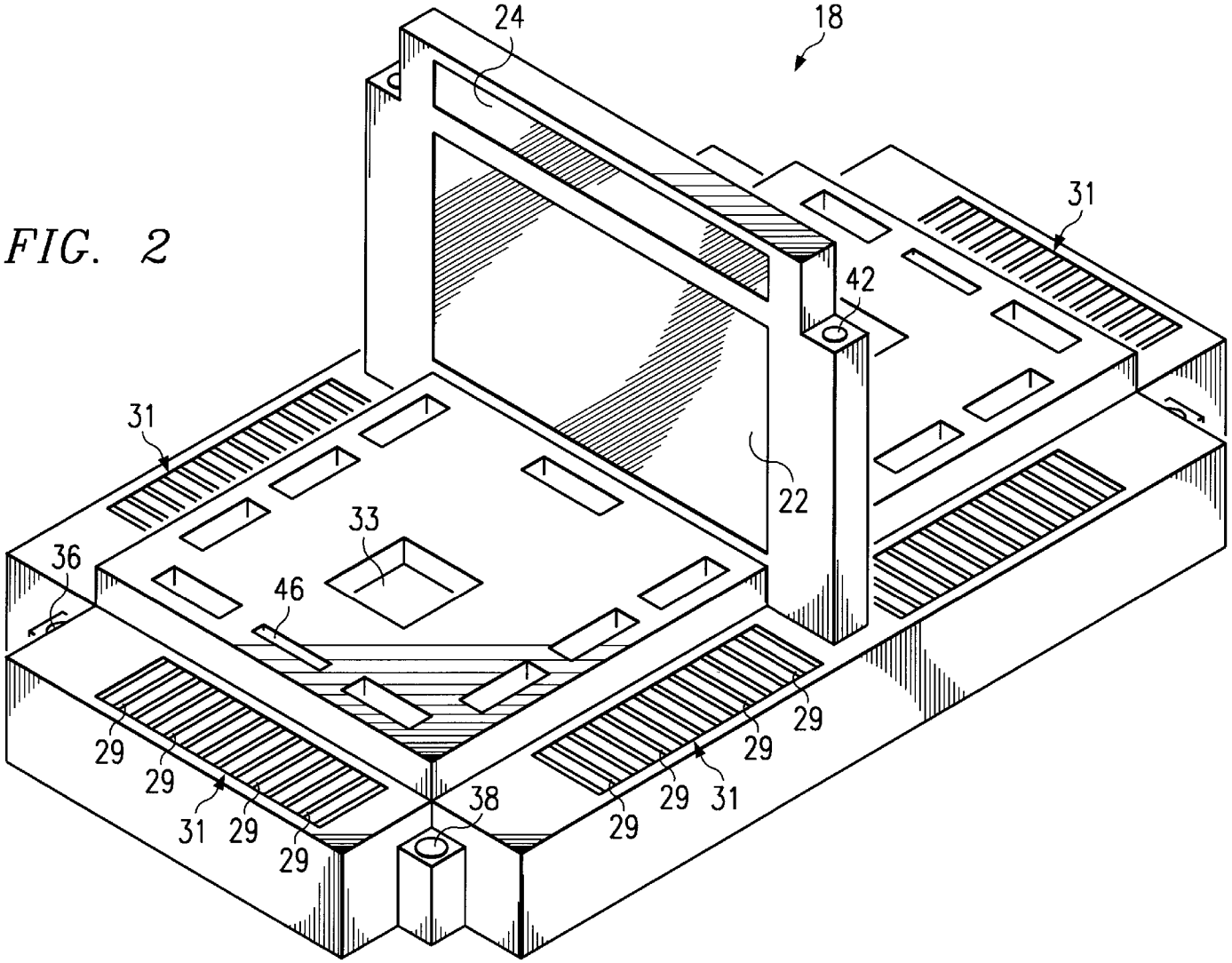
FIG. 2 is a perspective view of the preferred embodiment of the electronic display.

Referring now to FIGS. 2 and 3, an electronic display 18 is placed within the center of the game board 10. The electronic display 18 includes a processing unit 20 for controlling the stock value display 22 and portfolio value display 24. The stock value display 22 provides visual indicators for each of the stocks used within the game to indicate the present value of the stock. These indicators preferably comprise LED displays showing the value of the stocks in increments of $10.00 from $10.00 to $100.00. However, it should be realized that any other increment values or currency values could be used. A portfolio value display 24 provides a real time display indicating the present value of each player's stock portfolio. The manner for calculating the value of the stocks and stock portfolios will be more fully discussed in a moment.

Each stock in the game has five stock ownership tokens 25 associated with it. These ownership tokens 25 are received in a particular order as the player lands on movement units associated with the stock on the game piece pathway. Each token represents a particular level of ownership for the stock and actuates a different valuation algorithm for the player's stock portfolio based upon the player's ownership level. Upon landing on the movement unit the first time, the user receives the first ownership token 25, representing the first ownership level, associated with the stock represented by the movement unit. On each subsequent landing, a player receives the next available ownership token 25 until all ownership tokens for the stock are distributed. Each ownership token 25 includes means for actuating 27 a particular valuation algorithm 28 stored within the memory 30 of the electronic display 18. The ownership tokens 25 actuate valuation algorithms 28 providing a portfolio with successively higher values as each subsequent ownership token is inserted within stock actuation slots 29 on the portfolio areas 31 of the electronic display 18. The processor unit 20 determines the value of the portfolio in accordance with the selected valuation algorithm 28 and the present value for the stock. The result is displayed on the portfolio value display 24. The values of stocks during game play are generated by a random number module 23 that randomly alters the values of stocks to mimic rising and falling stock prices.

Other movement units upon the game piece movement pathway may require a player to draw one of a plurality of action cards 33 located on the surface of the electronic display. These action cards 33 require a player to push either a bull or bear market button 38, 36 that alters the overall average value of the stocks. When the bull button 38 is pushed, the random number module 23 recalculates the values of each of the stocks in a manner such that the overall average value of the stocks are higher than they were previous to pushing the bull button. Likewise, if a bear market card is drawn and the bear button pushed 36, the random number module 23 recalculates the value of each stock such that the overall average value of the stocks decreases. A high volume trading button 42 randomly effects the overall average valuation of each stock in an unexpected manner. Recalculated stock values require a recalculation of the portfolio values based on the new stock values and the actuated valuation algorithm.

The electronic display 18 further includes a stock valuation means 44 actuated by insertion of an ownership token 25 into a valuation slot 46 to determine the current value of the individual stock ownership token. This action overrides the portfolio value display 24 to display the current value of the stock associated with the ownership token 25 inserted within the valuation slot 46.

The game is generally played in the following manner. From an initial position, players roll a dice to indicate a number of movements units and then moves their game piece in accordance with their roll. If the player lands on a space associated with a particular stock, they are able to purchase the first ownership token 25 associated with that particular stock. This ownership token 25 is then inserted into the stock actuation slot 29 associated with that stock and the value for the portfolio is calculated accordingly to the valuation algorithm 28 selected by the ownership token and the present value of the stock. The value of the player's portfolio is then updated on the portfolio value display 24. The player might also land on a movement unit requiring the drawing of an action card 33 or a space requiring some other type of penalty or bonus. Game play continues in this manner with the players building up their stock portfolios as they move around the game piece movement pathway 14. Once the game play ceases, the player having the largest value stock portfolio wins.

It should be appreciated by those skilled in the art that the specific embodiments disclosed above may be readily utilized as a basis for modifying or designing other structures for carrying out the purpose of the present invention. It should also be realized by those skilled in the art that such equivalent constructions do not depart from the spirit and scope of the invention as set forth in the appended claims.

What is claimed is:

1. A stock market game apparatus comprising:

a game board defining a game piece movement pathway thereon, said pathway comprising a plurality of movement units wherein at least some of the movement units are associated with a plurality of stocks;

means for displaying current values of the plurality of stocks and current values of a plurality of stock portfolios owned by each player;

a plurality of ownership tokens associated with each of the plurality of stocks, wherein each ownership token affects the value of a stock portfolio associated with that ownership token based upon a current value of the stock associated with that token; and means for calculating the value of the stock portfolios from the plurality of ownership tokens associated with each player and sending the calculated values to the means for displaying.

2. The apparatus of claim 1 wherein the means for displaying comprises an electronic display.

3. The apparatus of claim 1 wherein the means for displaying further includes a processor for determining the value of a stock portfolio according to a selected one of a plurality of valuation algorithms and a current value of a stock.

4. The apparatus of claim 3 further including means for determining a current value of stock in response to the activation means of one of the plurality of ownership tokens.

5. The apparatus of claim 3 further including means for altering the average values of the plurality of stocks as determined by the processor.

6. The apparatus of claim 5 wherein the means for altering comprises means for increasing the average value for the plurality of stock.

7. The apparatus of claim 5 wherein the means for altering comprises means for decreasing the average value for the plurality of stock.

8. The apparatus of claim 3 further including means for randomly altering the values of the plurality of stocks.

9. The apparatus of claim 1 further including action cards describing actions effecting the value of the plurality of stocks.

10. A stock market game apparatus comprising:

a game board defining a game piece movement pathway thereon, said pathway comprising a plurality of movement units wherein at least some of the movement units are associated with a plurality of stocks;

an electronic display for displaying current values of the plurality of stocks and current values of a plurality of stock portfolios owned by each player, the electronic display further comprising;

a plurality of valuation algorithms for determining the value of a stock portfolio; and a processor for determining the value of a stock portfolio according to a selected one of the plurality of valuation algorithms and a current value of each stock contained in the stock portfolio;

a plurality of ownership tokens associated with each of the plurality of stocks, wherein each ownership token alters the value of a stock portfolio associated with the ownership token according to a valuation algorithm selected by a combination of ownership tokens associated with the stock portfolio and a current value of the stock associated with the ownership tokens; and a portfolio calculation area wherein a certain player's ownership tokens are placed for calculation of the player's stock portfolio by the electronic display.

11. The apparatus of claim 10 wherein the electronic display further includes a random number generator for randomly altering the values of the plurality of stocks.

12. The apparatus of claim 10 further including means for determining a current value of stock in response to the activation means of one of the plurality of ownership tokens.

13. The apparatus of claim 10 further including means for altering the average values of the plurality of stocks as determined by the processor.

14. The apparatus of claim 13 wherein the means for altering comprises means for increasing the average value for the plurality of stock.

15. The apparatus of claim 13 wherein the means for altering comprises means for decreasing the average value for the plurality of stock.

16. The apparatus of claim 10 further including means for randomly altering the values of the plurality of stocks.

17. The apparatus of claim 10 further including action cards describing actions effecting the value of the plurality of stocks.

18. A stock market game for a plurality of players, each attempting to acquire a stock portfolio comprising at least one of a plurality of stocks, the game comprising:

a plurality of game pieces, each associated with one of said players;

a plurality of stock ownership tokens, each associated with one of said stocks;

a game board having a playing surface with a game piece movement pathway thereon, said game piece movement pathway comprising a plurality of movement units, at least some of which correspond to one of said plurality of stocks;

a device for generally randomly indicating a number of movement units a player's game piece is moved along the movement pathway, wherein if the game piece lands on a movement unit associated with a stock, the player may acquire the stock ownership token associated with said stock;

a processor for determining values of the stock portfolios of said players based upon a selected one of a plurality of valuation algorithms, said algorithms being selected based upon which ownership tokens are associated with each given stock portfolio and a level of ownership in a given stock based on which ownership token associated with that stock is in the given stock portfolio; and a display operated by the processor for showing the current value of any of the stocks as well as the current value of each of the stock portfolios owned by the game players.

* * * * *